US005486035A

United States Patent [19]

Koepke et al.

[11] Patent Number: 5,486,035

[45] Date of Patent: Jan. 23, 1996

[54] OCCUPANT WEIGHT OPERATED CHAIR

[76] Inventors: Marcus C. Koepke, 302 Farwell; Earl H. Koepke, 65896 Scenic View Dr., both of Sturgis, Mich. 49091

[21] Appl. No.: 283,553

[22] Filed: Aug. 1, 1994

[51] Int. Cl.[6] ..... A47C 1/02

[52] U.S. Cl. ..... 297/320; 297/300.1; 297/302.1; 297/340; 297/354.1

[58] Field of Search ..... 297/320, 321, 297/301, 300, 302, 354.1, 340, 300.1, 301.1, 302.1

[56] References Cited

U.S. PATENT DOCUMENTS

| | | | |
|---|---|---|---|
| 868,052 | 10/1907 | Wilmot . | |
| 2,365,200 | 12/1944 | Lorenz | 155/55 |
| 3,133,765 | 5/1964 | Kramer | 297/445 |
| 3,140,118 | 7/1964 | Dorn | 297/440 |
| 3,146,028 | 8/1964 | Grosfillex | 297/440 |
| 3,874,727 | 4/1975 | Mehnert et al. | 297/320 |
| 4,451,085 | 5/1984 | Franck et al. | 297/285 |
| 4,962,962 | 10/1990 | Machate et al. | 297/302 |
| 5,102,196 | 4/1992 | Kaneda et al. | 297/457 |
| 5,251,958 | 10/1993 | Roericht et al. | 297/321 |
| 5,308,145 | 11/1994 | Koepke et al. | 297/342 |
| 5,314,237 | 5/1994 | Koepke et al. | 297/318 |
| 5,318,346 | 6/1994 | Roossien et al. | 297/301 |
| 5,366,274 | 11/1994 | Roericht et al. | 297/321 |

*Primary Examiner*—Peter M. Cuomo
*Assistant Examiner*—Anthony D. Barfield
*Attorney, Agent, or Firm*—Beaman & Beaman

[57] ABSTRACT

A chair having a reclinable back having a seat and back interconnected by a stiff resiliently flexible transition connection connecting the seat rear portion and the back lower portion, the seat forward portion and back portion being mounted upon a support whereby reclining of the back raises the seat rear portion producing an occupant weight operated reclinable chair having a substantially uniform back reclining force requirement throughout the reclining range of motion.

7 Claims, 2 Drawing Sheets

OCCUPANT WEIGHT OPERATED CHAIR

BACKGROUND OF THE INVENTION

1. Field of the Invention

An occupant weight operated chair having a seat and reclinable back wherein the seat and back are interconnected by a flexible transition connection wherein the reclining forces are automatically regulated by the occupant's weight.

2. Description of the Related Art

Chairs have been previously formed and molded having integral seat and back portions interconnected by flexible transition sections wherein such chairs have a degree of flexibility permitting very limited reclining. Chairs of such nature are shown in U.S. Pat. Nos. 3,146,028; 3,133,765 and 5,102,196.

It is also known to provide chairs having a reclinable back wherein the seat and back portions are supported and interconnected by pivots and linkages wherein reclining is achieved by forcing the back rearwardly, and with some such chair configurations, integral seat and back portions have been proposed. In this respect, note U.S. Pat. Nos. 868,052; 2,365,200; 3,140,118; 3,874,727; and 4,451,085.

Prior reclinable chair configurations having reclinable backs require that the reclining forces on the back overcome springs, or the like, and the occupant's torso or legs are employed as a weighted leverage to produce the reclining action. In such constructions, the difficulty of reclining the chair, i.e. generating the reclining force, increases the further the chair is reclined, and it is common to employ adjusting apparatus for increasing or decreasing the reclining tension of a chair, such adjusting apparatus changing the tension of a spring, or otherwise modifying the reclining mechanism.

Prior art reclinable chairs do not use the occupant's weight for automatically adjusting the reclining tensions or forces, and, accordingly, prior art chairs of the reclinable type are relatively complicated and expensive, and often require special skills to achieve the desired reclining tension or forces.

OBJECTS OF THE INVENTION

It is an object of the invention to provide an occupant weight operated chair having a reclining back wherein the occupant's weight loads the chair mechanism and automatically adjusts the reclining tension or force to recline the chair back.

Another object of the invention is to provide an occupant weight operated chair having a reclining back wherein the occupant's weight loads the chair mechanism and the force required to recline the chair back throughout its range of movement is substantially uniform, and no springs or adjustments are required to increase or decrease the chair reclining force.

Yet another object of the invention is to provide an occupant weight operated chair having a reclinable back wherein the back is attached to the seat rear region in such a manner that reclining of the back raises the elevation of the seat rear region against the occupant's weight, the lower region of the back being connected to the seat rear region by a stiff resilient flexible material defining a downward concave configuration, the concave configuration tending to straighten as the seat back is reclined.

Yet another object of the invention is to provide an occupant weight operated chair having a reclinable back wherein the chair is of a simple economical construction and lends itself to high production manufacturing and fabrication procedures.

SUMMARY OF THE INVENTION

An occupant weight operated chair in accord with the inventive concepts includes a chair having a seat and a back mounted upon support structure, such as a caster mounted pedestal. The back is reclinable with respect to the seat, and the structure of the chair, and the relationship of the components, is such that as the back is reclined the rear portion of the seat will raise against the weight of the occupant. In this manner, the occupant's weight loads the chair mechanism, and the force required to recline the back is substantially uniform throughout the back reclining range of movement, such force being regulated by the weight of the occupant upon the seat rear portion.

Preferably, the back and seat portions are formed of a molded, stiffly flexible and resilient, synthetic plastic material, such as a reinforced glass fiber or other high strength material capable of flexing. The seat includes a front portion, and a rear portion disposed toward the back. The back includes a lower region, and the seat rear portion and the back lower region are interconnected at a stiffly resilient flexible transition connection between the seat and back.

The underside of the seat front region is connected to the support, either fixed thereto, or connected by a pivot, and the lower region of the back is connected to a link, either fixed thereto or pivotally mounted thereto, and the link, in turn, is pivotally mounted to the chair support at a location below the transition connection between the seat and back, this pivotal connection being located rearwardly of the intersection of the transition connection with the seat rear portion.

The seat, between its front and rear portions, is of a downward concave configuration, and the transition connection is, likewise, of a downward concave configuration intermediate the seat rear portion and the back lower portion.

The concave configuration of the seat and transition connection generates a greater length along the configuration of the seat and the transition connection than the straight line distance between the point the seat front region is attached to the support, and the point at which the back lower region is connected to its link. Accordingly, due to the greater length of the concave configuration of the seat and transition connection than the straight line distance interconnecting the support points for the seat and back, as the seat reclines, and the link pivots rearwardly about its support, the distance between the support points for the seat and back increases and the concave configuration of the seat and the transition connection tends to straighten. This straightening of the seat and transition connection configuration lifts the seat rear region against the occupant's weight, and accordingly, it will be appreciated that it is the occupant's weight which "loads" the back to resist the reclining forces, and a seat constructed in accord with the invention has a substantially uniform resistance to reclining due to the fact that it is the occupant's weight which produces such resistance. As the reclining tension is adjusted by the weight of the occupant, the greater the occupant's weight, the greater the force required to recline the seat back, and vice versa.

No springs or adjusting mechanism is required to regulate the back reclining tension or adjusting force, and the automatic aspect of the chair operation simplifies the structure and reduces the manufacturing and fabrication costs.

BRIEF DESCRIPTION OF THE DRAWINGS

The aforementioned objects and advantages of the invention will be appreciated from the following description and accompanying drawings wherein.

DESCRIPTION OF THE PREFERRED EMBODIMENT

Figure 1:
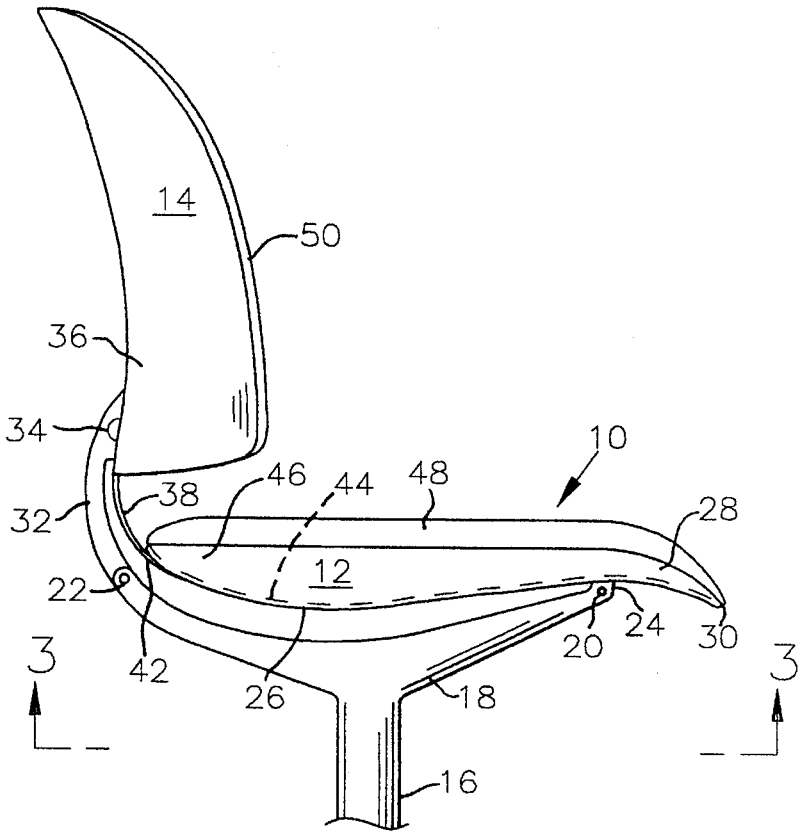
FIG. 1 is a side elevational view of an occupant weight operated chair in accord with the invention, the back being shown in the upright position.

An occupant weight operated chair in accord with the inventive concepts is generally indicated in the drawings by reference numeral 10. The chair 10 includes a seat 12 and a reclinable back 14 capable of reclining rearwardly with respect to the seat 12. Padded cushions may be mounted on the seat and back.

The seat and back are mounted upon a vertically oriented pedestal 16 which would usually be mounted upon a base consisting of four or five radially extending legs which may include casters, as is commonly employed with chairs. The base constitutes no part of the instant invention, and is not illustrated.

At its upper end, the pedestal 16 includes an elongated support arm 18 which is substantially horizontally disposed. The support arm 18 includes a forward end including a pivot connection 20, while the rear portion of the support arm 18 includes a pivot 22. The support pivot 20 is mounted upon the seat 12 at a point of attachment 24, and the point of attachment will normally include a bracket or similar configuration formed on the seat lower surface 26 cooperating with the pivot 20. The seat 12 includes a front region 28 adjacent the front edge 30, and the point of attachment 24 will usually be approximately three inches from the front edge 30.

Figure 2:
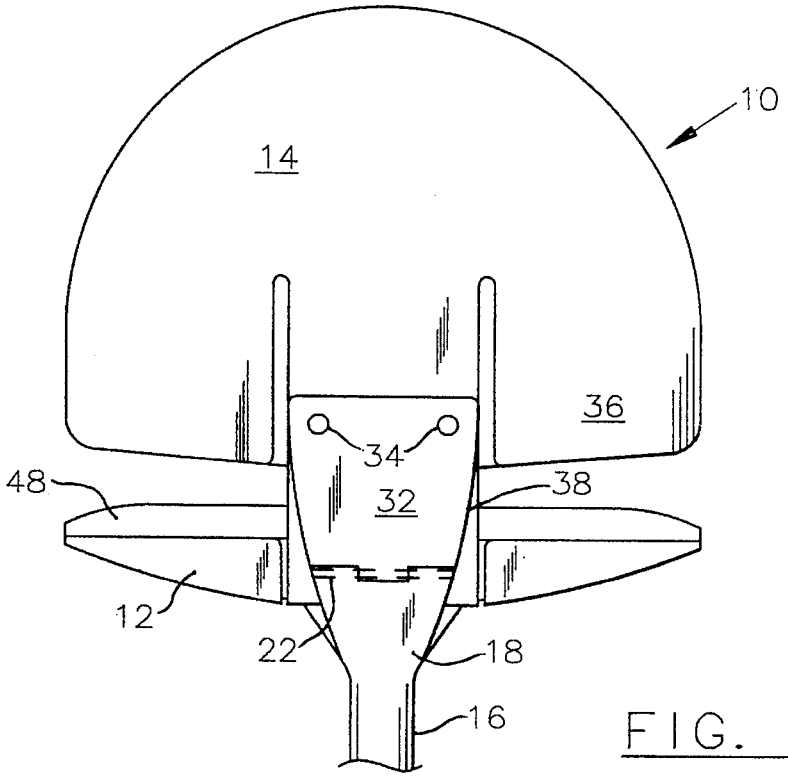
FIG. 2 is a side elevational rear view of the chair of FIG. 1 as taken from the left.

The support arm rear pivot 22 is pivotally connected to a link 32 which is of a curved configuration and is fastened to the seat back 14 by fasteners 34, FIG. 2, connecting the link 32 to the back lower region 36.

Figure 3:
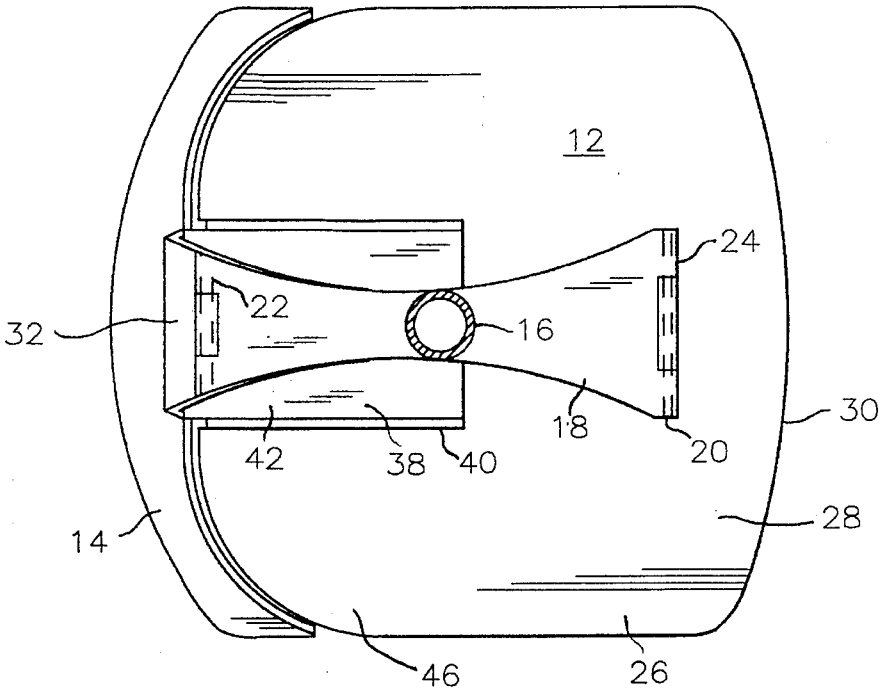
FIG. 3 is a bottom plan view of the chair of FIG. 1 as taken along Section 3—3.
Figure 4:
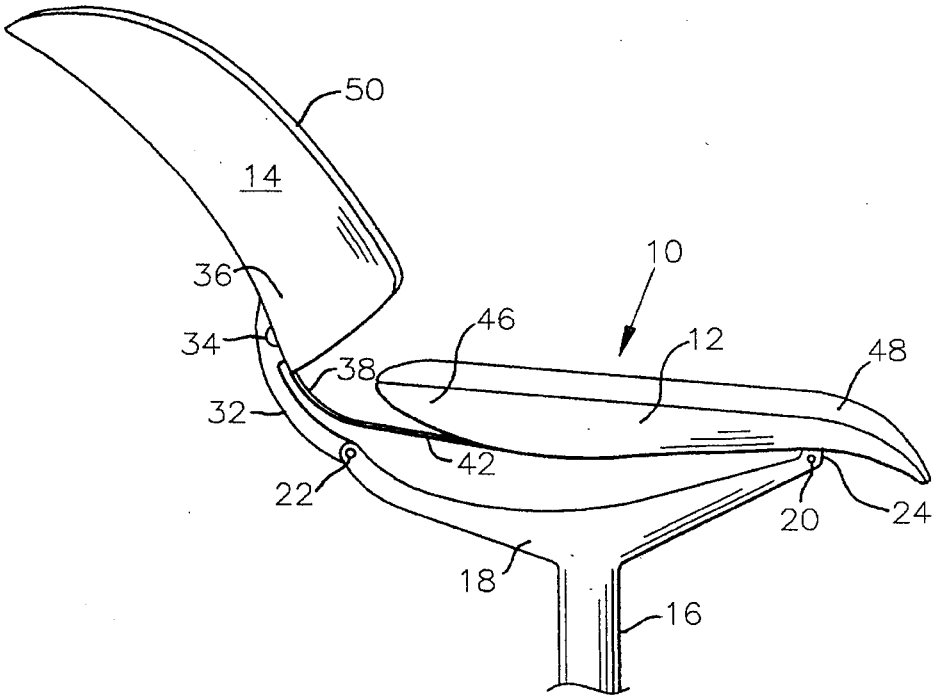
FIG. 4 is a side elevational view of the chair illustrating the back in a reclined position.

A flexible transition connection 38 extends downwardly from the back lower region 36, and as will be appreciated from FIGS. 1 and 4, the transition connection is of an arcuate downwardly concave configuration and is preferably homogeneously molded of the material of the back 14. The transition connection 38 is connected to the seat lower surface 26 in that the connection 38 is received within a recess 40, FIG. 3, defined in the seat lower surface 26, and the transition connection 38 may be bonded or otherwise fastened within the seat recess 40.

The intersection between the transition connection 38 and the seat 12 is generally indicated by reference numeral 42, and it is to be appreciated that it is the forward portion of the transition connector 38 which is attached to the seat recess.

The seat 12 includes a concave inner surface 44, as shown in dotted lines in FIG. 1, and the seat rear region adjacent the recess 40 is indicated at 46. For purposes of comfort, a foam cushion 48 may be bonded or otherwise affixed within the seat 12, while likewise, a back cushion 50 may be bonded to the back 14.

The seat 12 and the transition connection 38 are formed of a stiff moldable synthetic plastic material such as reinforced glass fiber, or similar material commonly used in the manufacture of molded chairs. This material must be sufficiently resilient and flexible to permit the required deformation during seat reclining, and preferably the back 14 is formed of the same material and as indicated above, in the preferred construction the transition connection 38 is a homogeneous extension of the material of the back lower region 36. The shell of the seat 12 as defined by the seat lower surface 26 and inner surface 44 is of a concave configuration between the seat front and rear portions being concave in a downward direction toward the pedestal 16. Likewise, as will be appreciated from FIGS. 1 and 4, the transition connection 38 is of a concave downward configuration between the seat rear region 46 and the back lower region 36. The degree of concavity of the seat shell and the transition connection 38 is sufficient to define a distance along the seat shell and transition connection which is greater than a straight line interconnecting the seat arm point of attachment 24 and the back point of attachment as represented by fasteners 34.

Also, it is to be noted from FIGS. 1 and 4, that the location of the support arm pivot 22 is rearwardly of the intersection 42 between the transition connector 38 and the portion of the transition connector attached to the seat.

Upon an occupant sitting within the seat 12, the weight of the occupant will tend to lower or depress the seat rear portion 46, and this action will tend to produce a counterclockwise rotation of the seat 12 about the pivot 20 as viewed in FIG. 1. Such a downward force on the seat rear region 46 will maintain the back 14 in its upright position shown in FIG. 1, and will firmly maintain the back 14 in its upright position against the back of the occupant. The fact that the link fasteners 34 and the pivot 22 are substantially in vertical alignment resists excessive forward movement of the back 14 as the occupant's weight is applied to the seat 12.

When it is desired to recline the back 14, the occupant will transfer force and weight to the back 14 in a reclining direction. Such action will cause the link 32 to pivot counterclockwise about the pivot 22 causing the link 32 to move rearwardly and downwardly, FIG. 4. As the link 32 moves rearwardly and downwardly, the concave configuration of the shell of seat 12 and the transition connection 38 tends to straighten, as will be apparent in FIG. 4, as the distance between the seat point of attachment 24 and the point of attachment of the link 32 to the back 14 increases, FIG. 4. This straightening of the configuration of the seat shell and the transition connection 38 causes the seat rear region 46 to rise, FIG. 4, which transfers a greater portion of the occupant's weight to the back 14 and thereby maintaining the amount of force necessary to recline back 14 substantially constant the further the back 14 is reclined.

The aforedescribed chair construction, and relationship of components, provides an occupant weight operated chair wherein the force required by the occupant to recline the back, regardless of their weight, is substantially uniform throughout the reclining range, and such regulation of the reclining force is automatically achieved. The further rearward the seat 14 reclines, the higher the seat rear portion 46 raises, and the chair of the invention automatically adjusts the reclining force by loading the chair mechanism by the occupant's weight. The heavier occupant will require a greater reclining force in that a greater weight is imposed upon the seat rear region 46, but such greater weight will also be applied to the back 14 during reclining. Adversely, a lighter occupant will not exert as great a weight on the seat rear region 46, and will not require as great a force to recline back 14.

It is to be understood that to achieve the desired results the configuration of the seat shell and transition connection must tend to straighten as the seat back is reclined, and the location of the pivot 22 and link 32 needs to be such that the distance between the point of attachment 24 and back point of attachment 36 increase during tilting. The inventive concept may be practiced if the forward end of the support arm is attached, rather than pivoted, to the seat at the point of attachment 24, and likewise, the inventive concept will be practiced if the link 32 is pivotally mounted to the back 14 rather than being rigidly affixed thereto by fasteners.

If molding techniques permit, the seat 12, back 14 and transition connection 38 could be molded as a single piece, and variations and modifications may be apparent to those skilled in the art without departing from the spirit and scope of the invention.

For instance, rather than using a single centered transition connection 38, as shown, the transition connection between the seat and back may consist of a pair of transition members each located adjacent the lateral sides of the rear of the seat and the bottom and functioning in the same manner as transition connection 38.

We claim:

1. An occupant weight operated chair having a seat and a reclining back wherein the force required to recline the back is substantially uniform throughout the range of reclining movement and is controlled by the chair occupant's weight comprising, in combination, a seat formed of a stiffly flexible material having front and rear portions, and a concave upper configuration and a convex lower configuration between said portions, a back having upper and lower portions and a rear exterior surface, a transition connection portion formed of a stiffly flexible material interposed between and interconnecting said seat rear portion and said back lower portion, said transition connection having a concave upper configuration and a convex lower configuration between said seat and back, a support having a front attachment to said seat front portion and a rear pivot located rearwardly of the point of attachment of said seat rear portion to said transition connection portion, a link pivotally mounted on said support rear pivot and affixed to said back lower portion at a fixed predetermined position defining a rear attachment, the dimension between said front attachment to said rear attachment along the configuration of said seat and transition connection being greater than the straight line dimension between said front and rear attachments whereby reclining of said back about said pivot to deform said transition connection and seat rear portion raises said seat rear portion, the chair occupant's weight upon said seat rear portion automatically adjusting the force required to recline said back.

2. In an occupant weight operated chair as in claim 1, said seat and said transition connection being formed of a stiff synthetic plastic material.

3. In an occupant weight operated chair as in claim 1, said seat and transition connection comprising separate interconnected components.

4. In an occupant weight operated chair as in claim 1, said seat and transition connection being homogeneously molded as single component.

5. In an occupant weight operated chair as in claim 1, said front attachment comprising a pivot pivotally interconnecting said support and said seat front portion.

6. In an occupant weight operated chair as in claim 1, said rear attachment comprising a pivot pivotally attaching said link to said back lower portion.

7. In an occupant weight operated chair as in claim 1, a pedestal having an upper end, said support being mounted upon said pedestal upper end.

* * * * *